US007007885B2

(12) United States Patent
Buckwitz

(10) Patent No.: US 7,007,885 B2
(45) Date of Patent: Mar. 7, 2006

(54) WIRE SEGMENT REEL ASSEMBLY AND METHOD

(75) Inventor: Richard J. Buckwitz, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/885,006

(22) Filed: Jul. 7, 2004

(65) Prior Publication Data

US 2006/0006272 A1 Jan. 12, 2006

(51) Int. Cl.

| | |
|---|---|
| ***B65H 49/28*** | (2006.01) |
| ***B65H 51/015*** | (2006.01) |
| ***B65H 54/00*** | (2006.01) |
| ***B65H 55/00*** | (2006.01) |
| ***B65H 75/18*** | (2006.01) |

(52) U.S. Cl. ..... 242/470; 242/615; 242/397; 242/407; 242/597.5; 242/614; 242/171; 242/172; 242/419.3

(58) Field of Classification Search ..... 242/470, 242/473.4, 362, 615, 578, 578.3, 571, 571.3, 242/397, 407, 597.5, 170, 171, 601, 419.3, 242/172, 614

See application file for complete search history.

(56) References Cited

U.S. PATENT DOCUMENTS

| | | | | |
|---|---|---|---|---|
| 2,998,878 | A * | 9/1961 | Biedinger et al. | 400/245 |
| 3,834,640 | A * | 9/1974 | Devaney, Jr. | 242/597.5 |
| 4,074,875 | A * | 2/1978 | Fratturo | 242/118.3 |
| 4,664,329 | A * | 5/1987 | Pali | 242/362.1 |
| 4,685,636 | A * | 8/1987 | Eaton | 242/129 |
| 4,715,549 | A * | 12/1987 | Travlos | 242/470 |
| 4,967,978 | A * | 11/1990 | Roberts | 242/129 |
| 5,503,341 | A * | 4/1996 | Kaneko et al. | 242/223 |
| 5,702,066 | A * | 12/1997 | Hurst et al. | 242/601 |

FOREIGN PATENT DOCUMENTS

GB 2277102 A * 10/1994

* cited by examiner

*Primary Examiner*—Kathy Matecki
*Assistant Examiner*—William E. Dondero
(74) *Attorney, Agent, or Firm*—Baker Hostetler LLP

(57) ABSTRACT

A reel assembly includes a reel having a magnet rim, turntable, magnetic key, and a wire feed tube. The reel is self starting and holds the feed wire upon the completion of winding.

18 Claims, 10 Drawing Sheets

WIRE SEGMENT REEL ASSEMBLY AND METHOD

FIELD OF THE INVENTION

The present invention relates generally to wiring spools. More particularly, the present invention relates to a coded wire segment spool delivery system.

BACKGROUND OF THE INVENTION

It is common in industry to build wire bundles. These processes often require that their incoming wire be coded with part number information, and cut to segment length, and delivered on individual spools. This results in spending considerable labor and floor space managing and handling sometimes hundreds or thousands of these spools.

The existing spools are made of firm plastic. They may be reworked narrow versions of the spools that the wire suppliers use to deliver wire to their customers. Existing spools may have the following dimensions in inches. Flange diameter: 12.0; Core diameter: 5.0; Center hole diameter: 1.5. Multiple sizes may be used where the width between flanges is 1.5 or 2.75 inches. The wider spool may be most common, its overall width is 4.2 inches.

It should be noted that the coding machines cannot load wire automatically onto the existing spools. The lead end of the wire is attached to the core of the spool by a piece of adhesive tape that is applied by hand. The trailing end of the wire is secured to the flange of the spool with another piece of tape that is also applied by hand.

Each spool occupies a large volume of space whether it contains a long, large cross-section, multi-conductor wire, or a short slender wire, or no wire at all. The carts for transporting these spools are necessarily quite large as well.

The current motor for winding up the spools is a small motor with manual speed controls. In operation, the coding operator codes about 10 feet of wire and stops the coding machine. Next, the operator tapes the lead end of the wire to the spool. The operator winds the slack wire onto the spool. Now, the operator starts the spool wind up motor and the coding machine. The wind up motor is adjusted to provide a small amount of wire tension and prevent slack wire. The operator guides the wire onto the spool so that it winds level. After the coding machine cuts the wire, the operator stops the wind up motor and tapes the trailing end of the wire to the spool rim.

Another common type of spool is made from two formed pieces of thin, stiff, sheet plastic. These pieces of plastic are typically welded together at the hub diameter of the spool. The flanges or rim of the this type spool is held closed by the springiness of the formed plastic. But, the rim is not held closed tight enough to retain the trailing end of the wire. Accordingly, there is still a need to secure the trailing end of the wire to the spool with tape. Also, the flexibility of the plastic allows the operator to open the spool then apply tape to the inside to secure the lead end of the wire to the spool.

Accordingly, it is desirable to provide a method and apparatus that overcomes the above-mentioned deficiencies by utilizing a self starting spool which includes a self clamping rim without the need of an operator to manually attach the ends of the wire to the spool.

SUMMARY OF THE INVENTION

The foregoing needs are met, to a great extent, by the present invention, wherein in one aspect an apparatus is provided that in some embodiments it is desirable to provide a method and apparatus that overcomes the above-mentioned deficiencies by utilizing a self starting and clamping spool without the need of a user manually handling the material. Also, this invention provides a spool which is volume efficient. The spool will be thin and flat when it is empty, but its sidewall will bulge and expand to accommodate a great volume of wire.

In accordance with one aspect of the present invention, a reel assembly is provided, comprising a turntable; a reel rotatably mounted on said turntable; a wire feed tube; a wire feed tube guide mounted proximal to said turntable; and a release key.

In accordance with another aspect of the present invention, there is provided a method of feeding wire to a reel, comprising the steps of: rotating the reel mounted on a turntable; opening a magnet rim of said reel; advancing a feed tube into said opening; inserting wire into said feed tube until it is grabbed by said rotating reel; retracting said feed tube when the end of the wire is approaching; and closing and holding said wire by said magnet rim.

In accordance with still another aspect of the present invention, there is provided a reel assembly, comprising a means for rotating the reel mounted on a turntable; a means for opening a magnet rim of said reel; a means for advancing and retracting a feed tube into said opening; a means for inserting wire into said feed tube until it is grabbed by said rotating reel; and a means for closing and holding said wire by said magnet rim.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
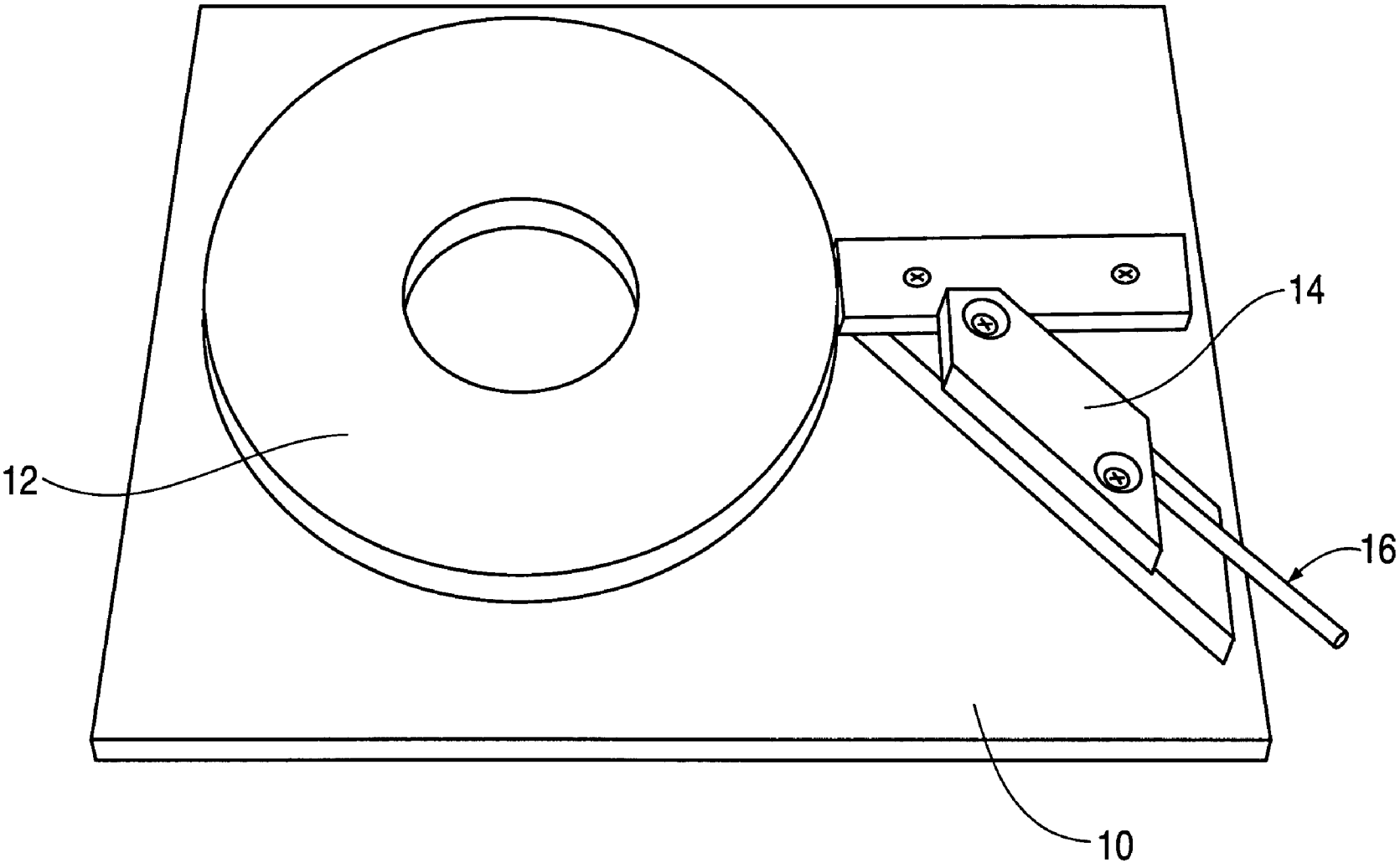
FIG. 1 is a perspective view illustrating a turntable and guide according to an embodiment of the invention.

The invention will now be described with reference to the drawing figures, in which like reference numerals refer to like parts throughout. An embodiment in accordance with the present invention provides a reel assembly including a reel 18, a turntable 12 with a motive source or motor 30, a bearing 31, a feed tube 16, a guide 14 and a base support 10.

Figure 2:
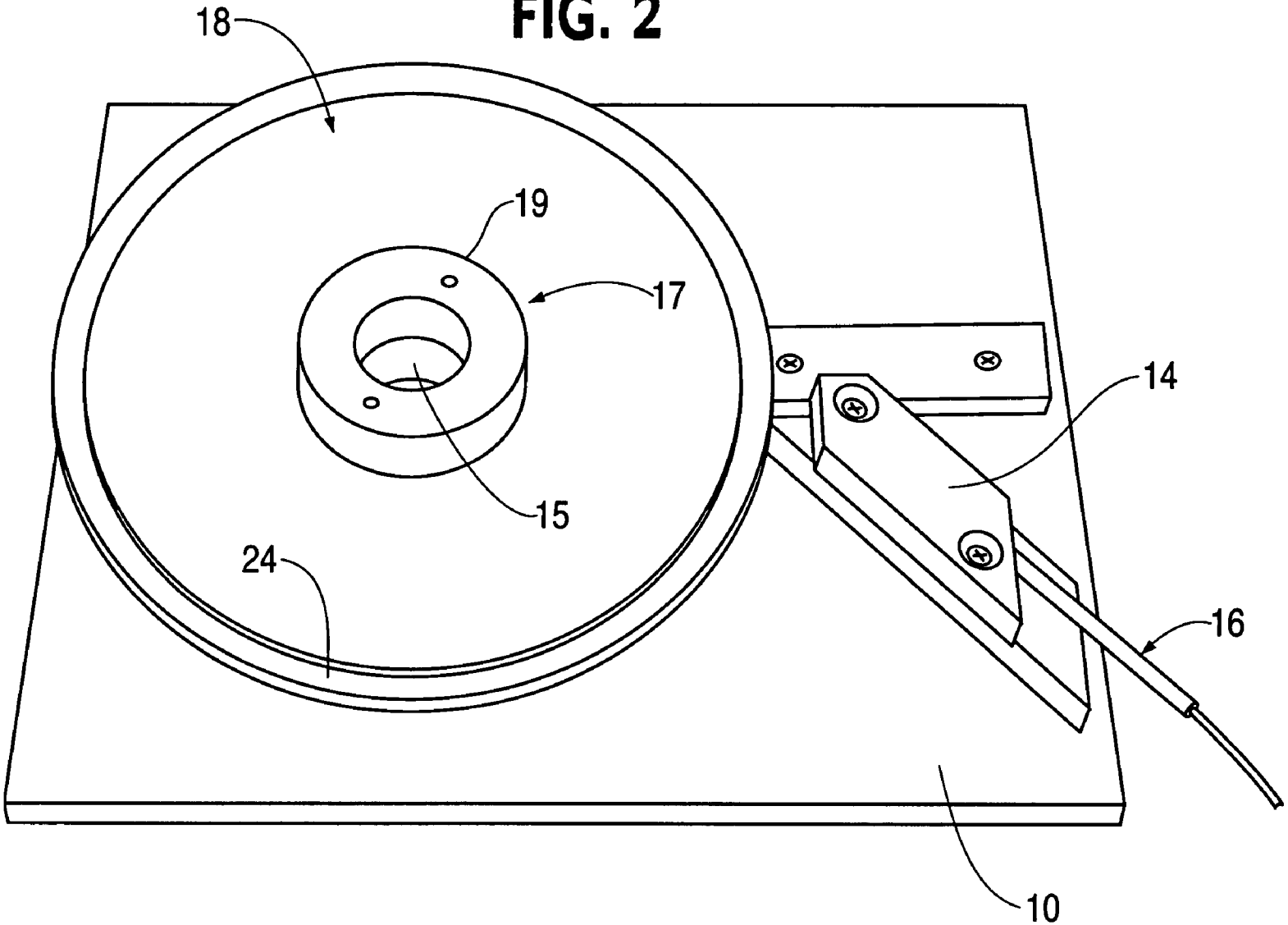
FIG. 2 is a perspective view of the reel mounted to the turntable of FIG. 1 and a feed tube aligned within the guide of FIG. 1.
Figure 3:
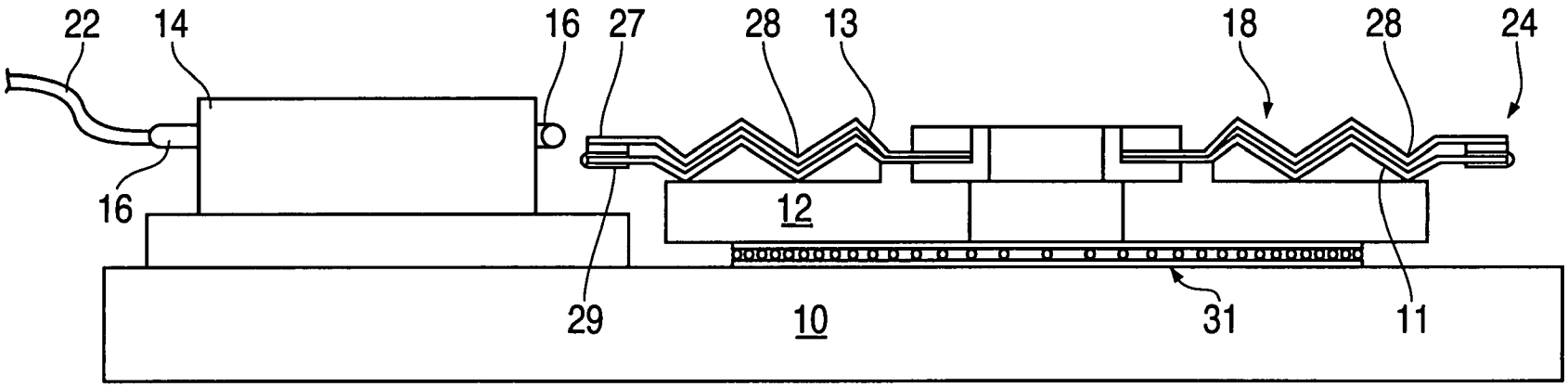
FIG. 3 is a cross-sectional side view of the reel mounted on the turntable of FIG. 2.

For clarity, the new spools per the present invention are referred to here as reels or reelettes. Referring to FIGS. 1–3, the reel 18 may have some dimensions the same as the current spools: Center hole diameter, Core diameter, and Flange diameter. The reel 18 can be self starting. The lead end of the wire 22 can be captured within the reel 18 to begin winding the wire 22 onto the reel 18. The trailing end of the wire 22 can be held by light friction or clamping by the rim 24 to prevent the wire 22 from unwinding from the reel 18. The reel 18 can have a small volume when it is empty, although its sides will expand via pleated flanges or sides 11, 13 in order to accept a large volume of wire when it is loaded. The self-starting feature of some embodiments of the present invention feeds wire 22 into the turning reel 18 and it will start winding up the wire 22. For loading wire 22, an opening is created for a feed tube 16 between the two rims 24, of the stationary reel 18. It should be noted that the rim 24 may comprise a flexible magnetic top portion 27 and a flexible ferrous or steel bottom portion 29.

In some embodiments the reel 18 holds the trailing end of the wire 22 by use of a magnetic ring 24 which holds and prevents the trailing end of the wire 22 from unwinding. The sides of the reel 18 are flat when empty and will flex or bulge when full of the wound wire 22.

The turntable 12 and guide 14 are mounted onto a base support 10. The guide 14 is fixedly mounted proximal the turntable 12 onto base 10. The turntable is rotatably mounted to the base 10 by the bearing 31.

Again referring to FIGS. 2 and 3, the reel 18 is mounted to the turntable 12. A motive source or motor 30 is connected to the turntable 12 for controlled rotation as shown in FIG. 6.

Figure 4:
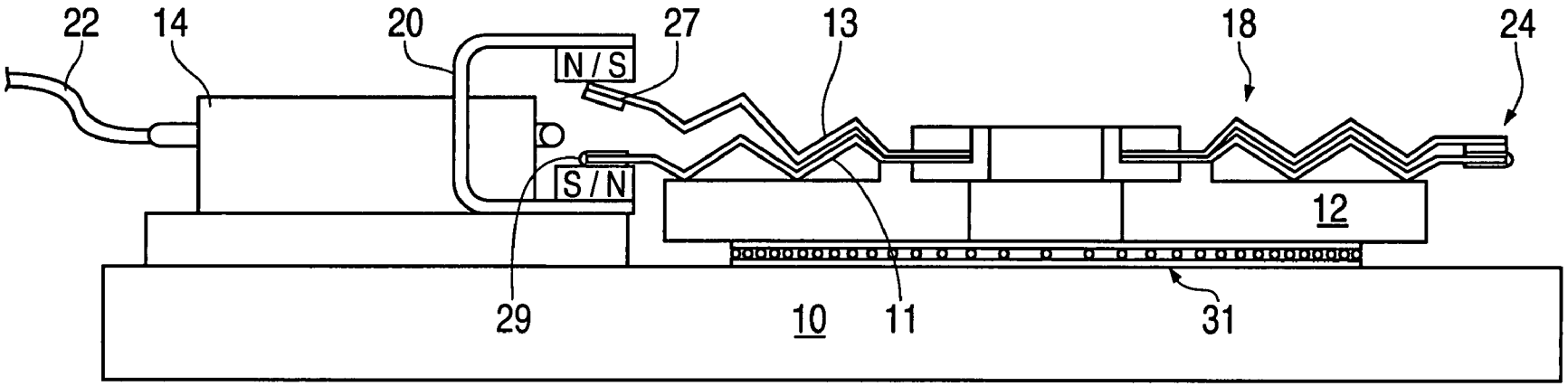
FIG. 4 is a cross-sectional side view of the reel on the turntable with the magnetic key opening the reel while the reel is stationary.

Referring to FIG. 4, the two sides or flanges 11, 13 of the reel 18 may be of soft flexible elastometric plastic. The material may be similar to a rubber diaphragm.

The center section 17 of the reel 18, which includes the center hole 15 and the core diameter 19, may be made of firm plastic. This center section 17 might be 0.75 inches wide.

Figure 5:
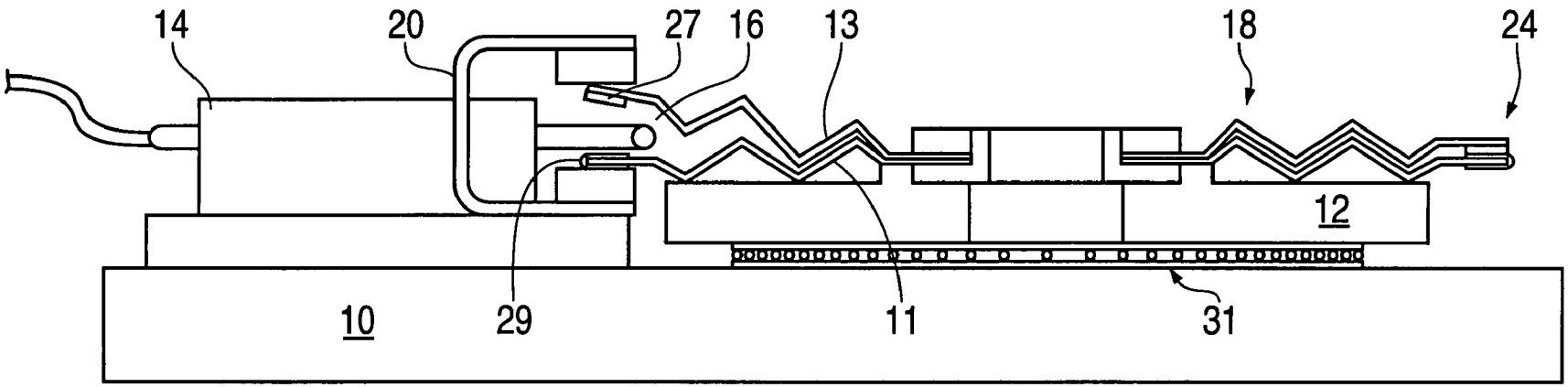
FIG. 5 is a cross-sectional side view of the present invention in an open position with the feed tube extended therein.
Figure 6:
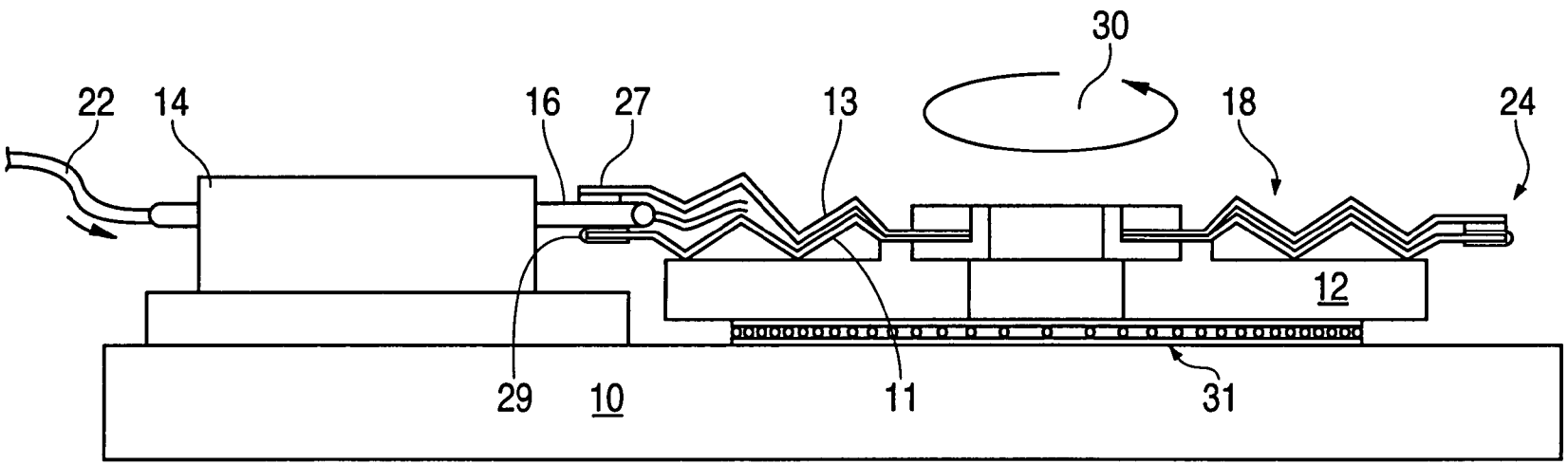
FIG. 6 is a cross-sectional side view of the present invention with a feed tube inserted within the reel rim and the magnetic key removed, wherein the reel is turning and wire is pushed into the reel.

Referring to FIGS. 5 and 6, during the automatic loading process at a conventional coding machine (not shown) a magnetic key 20 is positioned over the reel 18 where the wire 22 is inserted into the reel 18. This magnet key 20 causes the reel 18 to open its sides 11, 13 only at the point of wire insertion. The polarity of this assembly of magnets within key 20 is, from top to bottom N–S over S–N.

The magnetic key 20 consists of two magnets and a nonferrous bracket such as aluminum which holds them together. The magnets are arranged with their south poles toward each other. The rim 24 has a flexible magnetic top portion 27 above a flexible ferrous or steel bottom portion 29. The magnetic top portion 27 has its north pole positioned above its south pole. The ferrous or steel bottom portion 29 is attracted to the south pole of the magnetic top portion 27.

When the magnetic key 20 is brought into proximity with the two rims portions 27, 29 the following happens. The lower magnet (south) of the key 20 attracts the ferrous or steel bottom portion 29 while it also repels the (south) pole of the magnetic top portion 27. This causes the portions 27, 29 to separate. As the portions 27, 29 separate, the top surface (north) of the magnetic top portion 27 is attracted upward toward the upper (south) key magnet 20. This action causes the portions 27, 29 to open widely.

After the portions 27, 29 separate and the feed tube 16 is placed between the rim 24, then the magnetic key 20 is no longer needed, so it is removed. The feed tube 16 maintains the opening between the rim 24. An antifriction bearing may be used where the feed tube 16 abuts against the turning rim 24 of the reel 18.

Figure 7:
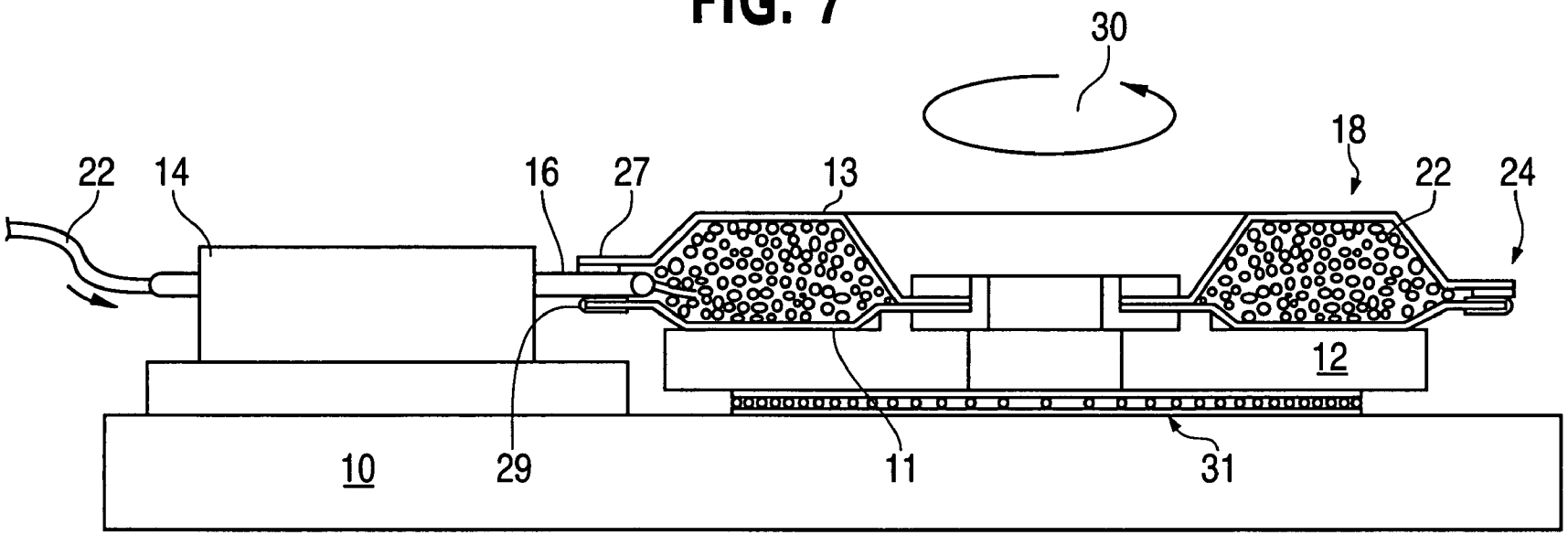
FIG. 7 is a cross-sectional side view showing the wire advancing within the feed tube in accordance with the present invention.

The reel 18 could be driven to turn counter clockwise as viewed from above with a drag clutch (not shown), and the wire insertion may occur at the 9 o'clock position as shown in FIGS. 6 and 7. The reel 18 would be held open by the feed tube 16 only at the 9 o'clock position even as it spins while being loaded with wire. The windup will be self-starting because the reel 18 has only one opening.

Figure 8:
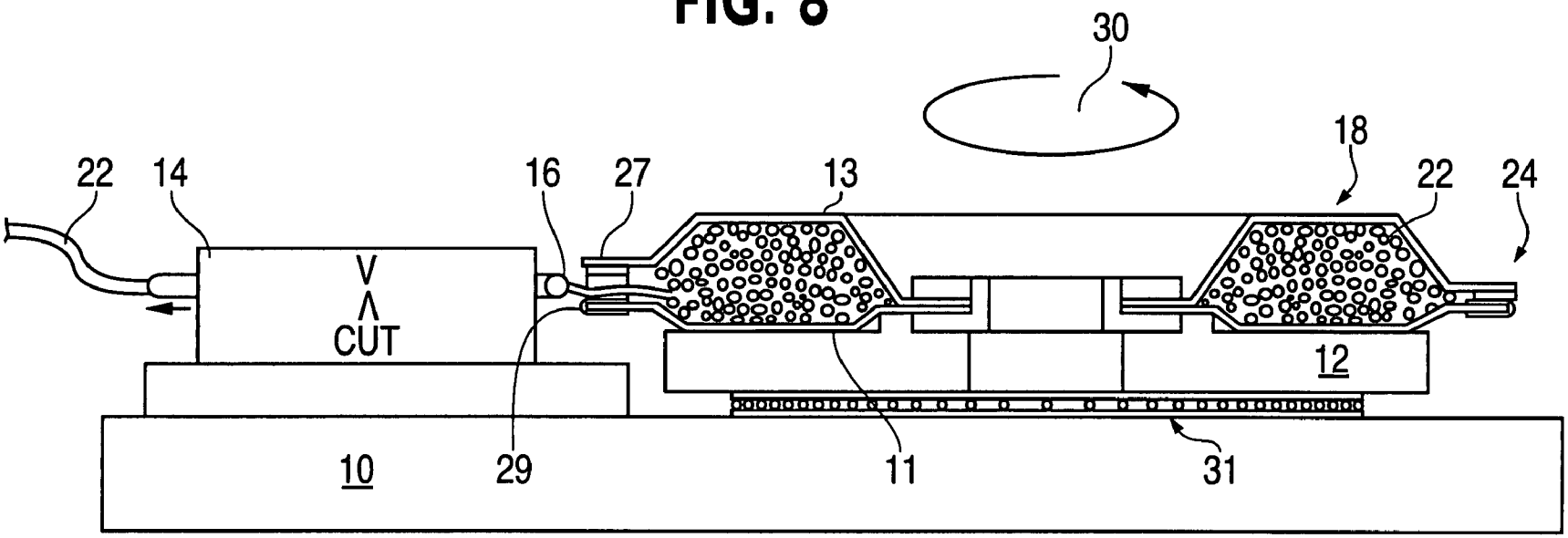
FIG. 8 is a cross-sectional side view showing the retraction of the feed tube from the reel.
Figure 9:
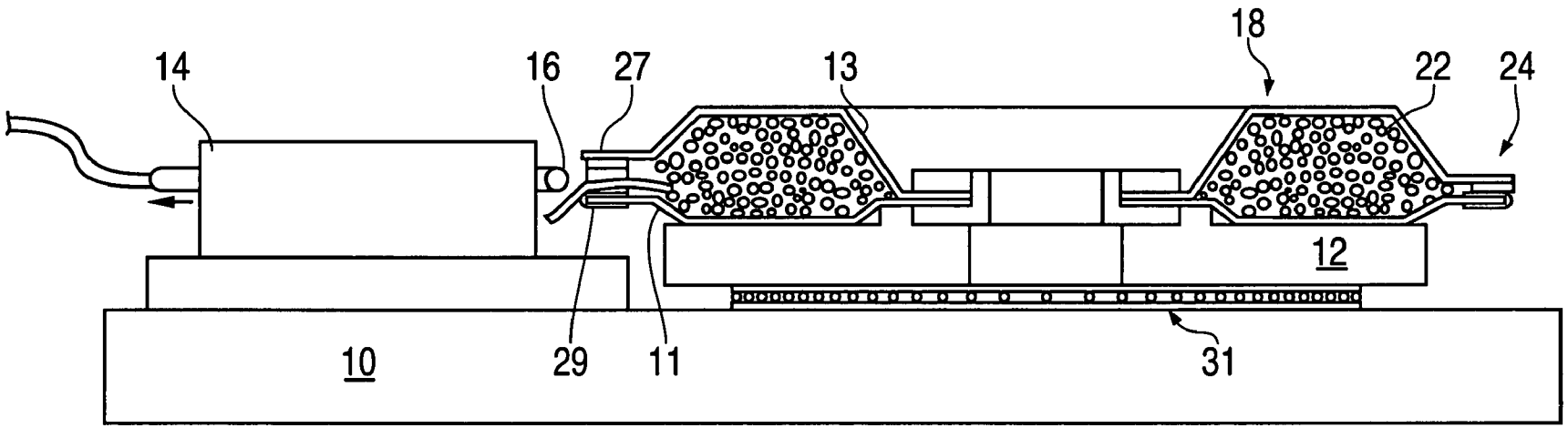
FIG. 9 is a cross-sectional side view showing the tail end of the wire outside the reel rim.
Figure 10:
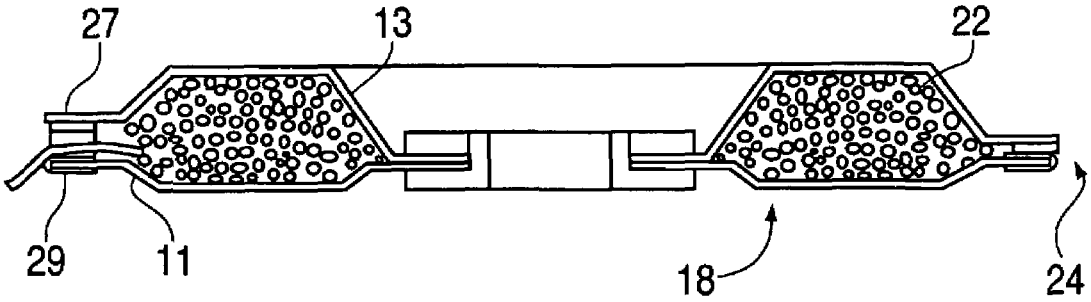
FIG. 10 is a cross-sectional side view of the present invention in a closed position separate from the turntable and full of reeled wire.

The conventional coding machine may run at about 60 to 100 feet per minute. The wire 22 is held firmly by the wire coding machine which controls the speed of the wire 22. The first few inches of wire 22 are pushed into the reel 18 by the wire coding machine. The reel 18 grabs the wire 22 with the friction of dragging between the two side-walls 11, 13. The lead end of the wire 22 stays within the reel 18 because the reel 18 has only the one opening, which is blocked by the feed tube 16. The reel 18 should be mounted to a turntable 12 which may be driven by a motive source 30 with speed and torque control. Initially the reel 18 will be driven slightly faster than what is required to wind up the delivered wire 22 at the reel 18 core diameter 19. Friction will draw the wire 22 to the center section 17 of the reel 18 as it begins to grab. The feed tube 16 extends only a little ways into the reel 18. The feed tube 16 may be flexible, allowing it to point towards the core or the rim of the reel 18. The reel 18 motive source 30 will operate with a light torque setting. Once the wire 22 is grabbed, the reel 18 will slow down to match the speed of the delivered wire. The wire tension will cause the wire 22 to wind-up outwards from the reel 18 core diameter 19 and the feed tube 16 may be removed after the wire is cut as shown in FIG. 8. Excessive wire tension will be avoided because it would distort the reel 18.

Referring to FIGS. 7–10, the two flexible sides 11, 13 may be mounted tight against each other onto the middle of the core diameter 19. The sides 11, 13 will have annular pleats 28 that expand or bulge when the reel 18 is loaded with wire 22.

When empty the two sides 11, 13 nest against each other from the core diameter 19 to the maximum flange diameter or rim and occupy a minimum volume.

The flexible magnetic top portion 27 and the flexible ferrous or steel bottom portion 29 at the maximum flange diameter hold the perimeter of the two sides of the reel 18 closed and snug against each other. The magnetic top portion 27 may have a polarity in cross-section from top to bottom of (n–s). The magnetic top portion 27 and the ferrous or steel bottom portion 29 lightly hold the trailing end of the wire 22 and prevent it from unwinding. Although, pulling on the exposed wire 22 will cause the reel 18 to turn and unwind.

Although an example of the present invention's reel assembly is shown using a wire, it will be appreciated that items other than wire can be used. Also, although the reel assembly is useful to maintain coded wire segments, it can also be used to coil or spool various items in other industries accordingly. Furthermore, instead of using a magnetic key 20 one may use two vacuum end effectors to separate the magnetic top portion 27 from the ferrous or steel bottom portion 29 and omit the magnetic key 20. Since the reel 18 is not turning during the opening process, the reel may be opened by applying vacuum to pull apart the upper and lower rim 24 surfaces. With this configuration the magnetic top portion 27 may be polarized in a zebra stripe pattern. This magnetic polarizing configuration can provide stronger magnetic attraction between the portions 27, 29. Of course the lower rim would remain as a flexible ferrous or steel bottom portion 29.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A reel assembly, comprising:

a turntable;

a reel rotatably mounted to said turntable, wherein said reel has a magnet rim portion;

a wire feed tube;

a wire feed tube guide mounted proximal to said turntable; and a magnetic release key disposed in cooperative alignment with the magnetic rim portion.

2. The reel assembly of claim 1, further comprising a rotational motive source connected to said turntable.

3. The reel assembly of claim 1, wherein said key is oppositely magnetically polarized to said magnet rim.

4. The reel assembly of claim 2, wherein said reel comprises pleated side walls.

5. The reel assembly of claim 4, wherein said pleated side walls are configured to flexibly grip a fed wire.

6. A method of feeding wire to a reel, comprising the steps of:

rotating the reel mounted on a turntable;

opening a magnet rim of said reel;

advancing a feed tube into said opening;

inserting wire into said feed tube until it is grabbed by said rotating reel;

retracting said feed tube when the end of the wire is approaching; and closing and holding said wire by said magnet rim.

7. The method of claim 6, wherein the magnet rim comprises a flexible material.

8. The method of claim 7, wherein the flexible material has concentric pleats in cross section.

9. The method of claim 7, wherein the opening step further comprises using a magnet key having opposite polarity to the magnet rim.

10. The method of claim 6, further comprising the step of keeping a tail end of the wire outside said magnet rim.

11. A reel assembly, comprising:

means for rotating a reel mounted on a turntable;

means for opening a magnet rim of said reel;

means for advancing and retracting a feed tube into said opening;

means for inserting wire into said feed tube until it is grabbed by said rotating reel; and means for closing and holding said wire by said magnet rim.

12. The reel assembly of claim 11, wherein the magnet rim comprises a flexible material.

13. The reel assembly of claim 12, wherein the flexible material has concentric pleats in cross section.

14. The reel assembly of claim 12, wherein the means for opening is a magnet key having polarity opposite that of the magnet rim.

15. The reel assembly of claim 11, further comprising means for keeping a tail end of the wire outside said magnet rim.

16. The reel assembly of claim 11, wherein said means for advancing and retracting is a guide disposed proximal to said reel.

17. The reel assembly of claim 11, wherein said means for rotating is a motive source.

18. The reel assembly of claim 11, wherein said flexible material is plastic.

* * * * *